US011251526B2

(12) United States Patent
Onaka et al.

(10) Patent No.: US 11,251,526 B2
(45) Date of Patent: Feb. 15, 2022

(54) ANTENNA DEVICE, ANTENNA MODULE, AND CIRCUIT BOARD FOR USE THEREIN

(71) Applicant: Murata Manufacturing Co., Ltd., Kyoto (JP)

(72) Inventors: Kengo Onaka, Kyoto (JP); Kaoru Sudo, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 211 days.

(21) Appl. No.: 16/740,003

(22) Filed: Jan. 10, 2020

(65) Prior Publication Data

US 2020/0153098 A1 May 14, 2020

Related U.S. Application Data

(63) Continuation of application No. PCT/JP2019/016088, filed on Apr. 15, 2019.

(30) Foreign Application Priority Data

Jul. 20, 2018 (JP) ..... JP2018-136699

(51) Int. Cl.
*H01Q 5/378* (2015.01)
*H01Q 1/38* (2006.01)

(52) U.S. Cl.
CPC ..... *H01Q 5/378* (2015.01); *H01Q 1/38* (2013.01)

(58) Field of Classification Search
CPC ..... H01Q 21/08; H01Q 9/0414; H01Q 1/38; H01Q 1/421; H01Q 5/378
See application file for complete search history.

(56) References Cited

U.S. PATENT DOCUMENTS 5,187,490 A * 2/1993 Ohta ..... H01Q 21/0081 343/700 MS
5,801,660 A * 9/1998 Ohtsuka ..... H01Q 9/0414 343/700 MS (Continued)

FOREIGN PATENT DOCUMENTS

CN 103179815 A 6/2013
CN 107785655 A 3/2018

(Continued)

OTHER PUBLICATIONS

Chinese Office action issued in Chinese Patent Application No. 201980003255.4 dated Jul. 3, 2020.

(Continued)

*Primary Examiner* — Graham P Smith
*Assistant Examiner* — Jae K Kim
(74) *Attorney, Agent, or Firm* — Pearne & Gordon LLP

(57) ABSTRACT

An antenna device is enclosed in a housing. The antenna device includes a dielectric substrate in which a plurality of layers including a ground layer is stacked on top of one another, a feed element, a parasitic element, a feed line, and a conductive member placed in or on the dielectric substrate. The feed element is placed within or on a surface of the housing, and the parasitic element is placed in the dielectric substrate. The feed line is placed, in the dielectric substrate, in a layer between a layer in which the parasitic element is placed and the ground layer and sends a radio frequency signal. When the dielectric substrate is attached to the housing, the conductive member electrically connects the feed line and the feed element and supplies a radio frequency signal to the feed element.

20 Claims, 5 Drawing Sheets

(56) References Cited

U.S. PATENT DOCUMENTS

| | | | | |
|---|---|---|---|---|
| 6,091,364 | A * | 7/2000 | Murakami | H01Q 1/084 343/700 MS |
| 6,359,588 | B1 * | 3/2002 | Kuntzsch | H01Q 9/0407 343/700 MS |
| 7,639,183 | B2 * | 12/2009 | Teshirogi | H01Q 1/3233 343/700 MS |
| 7,847,736 | B2 * | 12/2010 | Channabasappa | H01Q 1/38 343/700 MS |
| 2004/0104847 | A1 * | 6/2004 | Killen | H01Q 9/0442 343/700 MS |
| 2004/0164907 | A1 * | 8/2004 | Killen | H01Q 9/0457 343/700 MS |
| 2004/0263394 | A1 | 12/2004 | Harano | |
| 2005/0057412 | A1 * | 3/2005 | Hwang | H01Q 1/38 343/767 |
| 2009/0058731 | A1 * | 3/2009 | Geary | H01Q 9/0414 343/700 MS |
| 2010/0060535 | A1 * | 3/2010 | Tiezzi | H01Q 5/40 343/770 |
| 2011/0063174 | A1 * | 3/2011 | Cho | H01Q 9/0457 343/702 |
| 2011/0298667 | A1 * | 12/2011 | Surittikul | H01Q 9/0435 343/700 MS |
| 2012/0062428 | A1 | 3/2012 | Imano et al. | |
| 2017/0077614 | A1 * | 3/2017 | Lin | H01Q 1/36 |
| 2018/0062263 | A1 | 3/2018 | Ueda | |
| 2018/0076530 | A1 * | 3/2018 | Kawahata | H01Q 21/065 |
| 2019/0221937 | A1 | 7/2019 | Onaka | |

FOREIGN PATENT DOCUMENTS

| | | | | |
|---|---|---|---|---|
| GB | 2046530 | A * | 11/1980 | H01Q 9/0414 |
| JP | 06029723 | A * | 2/1994 | |
| JP | 2005-039797 | A | 2/2005 | |
| JP | 2012-235351 | A | 11/2012 | |
| JP | 2018-082277 | A | 5/2018 | |
| KR | 20140031360 | A * | 3/2014 | |
| WO | 2010-137210 | A1 | 12/2010 | |
| WO | 2018-074377 | A1 | 4/2018 | |

OTHER PUBLICATIONS

International Search Report Issued in Patent Application No. PCT/JP2019/016088 dated Jun. 25, 2019.

Written Opinion for International Patent Application No. PCT/JP2019/016088 dated Jun. 25, 2019.

* cited by examiner

ANTENNA DEVICE, ANTENNA MODULE, AND CIRCUIT BOARD FOR USE THEREIN

This is a continuation of International Application No. PCT/JP2019/016088 filed on Apr. 15, 2019 which claims priority from Japanese Patent Application No. 2018-136699 filed on Jul. 20, 2018. The contents of these applications are incorporated herein by reference in their entireties.

BACKGROUND OF THE DISCLOSURE

Field of the Disclosure

The present disclosure relates to antenna devices, antenna modules, and circuit boards for use therein, and more particularly to a structure of an antenna device for reducing an influence of a housing in which the antenna device is enclosed.

Description of the Related Art

For achieving the band broadening of an antenna device, a configuration in which a parasitic element is placed at a location away from a feed element is known.

Japanese Unexamined Patent Application Publication No. 2012-235351 (Patent Document 1) discloses an antenna device in which a multilayer board, on which a patch antenna is placed, is fixed to a housing. In the antenna device of the Patent Document 1, a parasitic element is formed on a cover that covers an opening part of the housing at a location opposite to the patch antenna away from the patch antenna.

Patent Document 1: Japanese Unexamined Patent Application Publication No. 2012-235351

BRIEF SUMMARY OF THE DISCLOSURE

In the antenna device disclosed in Japanese Unexamined Patent Application Publication No. 2012-235351 (Patent Document 1), space is formed between the multilayer board, on which the patch antenna is placed, and the cover. Therefore, while a radio wave radiated from the patch antenna excites the parasitic element, a part of the radio wave is reflected at the cover. In some cases, the reflected radio wave interferes with the radio wave radiated from the patch antenna, and this may prevent, in some cases, from obtaining the desired antenna characteristics.

The present disclosure is made to resolve such an issue, and an object thereof is, in an antenna device placed inside a housing, to suppress the degradation of the antenna characteristics by reducing the reflection of a radio wave radiated from a feed element at the housing.

An antenna device according to the present disclosure is enclosed in a housing. The antenna device includes a dielectric substrate in which a plurality of layers including a ground layer is stacked on top of one another, a first radiating element, a second radiating element, a feed line that sends a radio frequency signal, and a conductive member placed in or on the dielectric substrate. The first radiating element is placed within or on a surface of the housing. The second radiating element is placed in the dielectric substrate. The feed line is placed, in the dielectric substrate, in a layer between a layer in which the second radiating element is placed and the ground layer. The conductive member is configured in such a way that when the dielectric substrate is attached to the housing, the conductive member electrically connects the feed line and the first radiating element and supplies a radio frequency signal to the first radiating element.

According to the antenna device according to the present disclosure, the housing is provided with the first radiating element (feed element), and a radio frequency signal is supplied to the feed element from the feed line via the conductive member. Therefore, the reflection of a radio wave, which is radiated from the feed element, at the housing is suppressed. Accordingly, the degradation of the antenna characteristics due to the reflected radio wave is suppressed.

DETAILED DESCRIPTION OF THE DISCLOSURE

Figure 1:
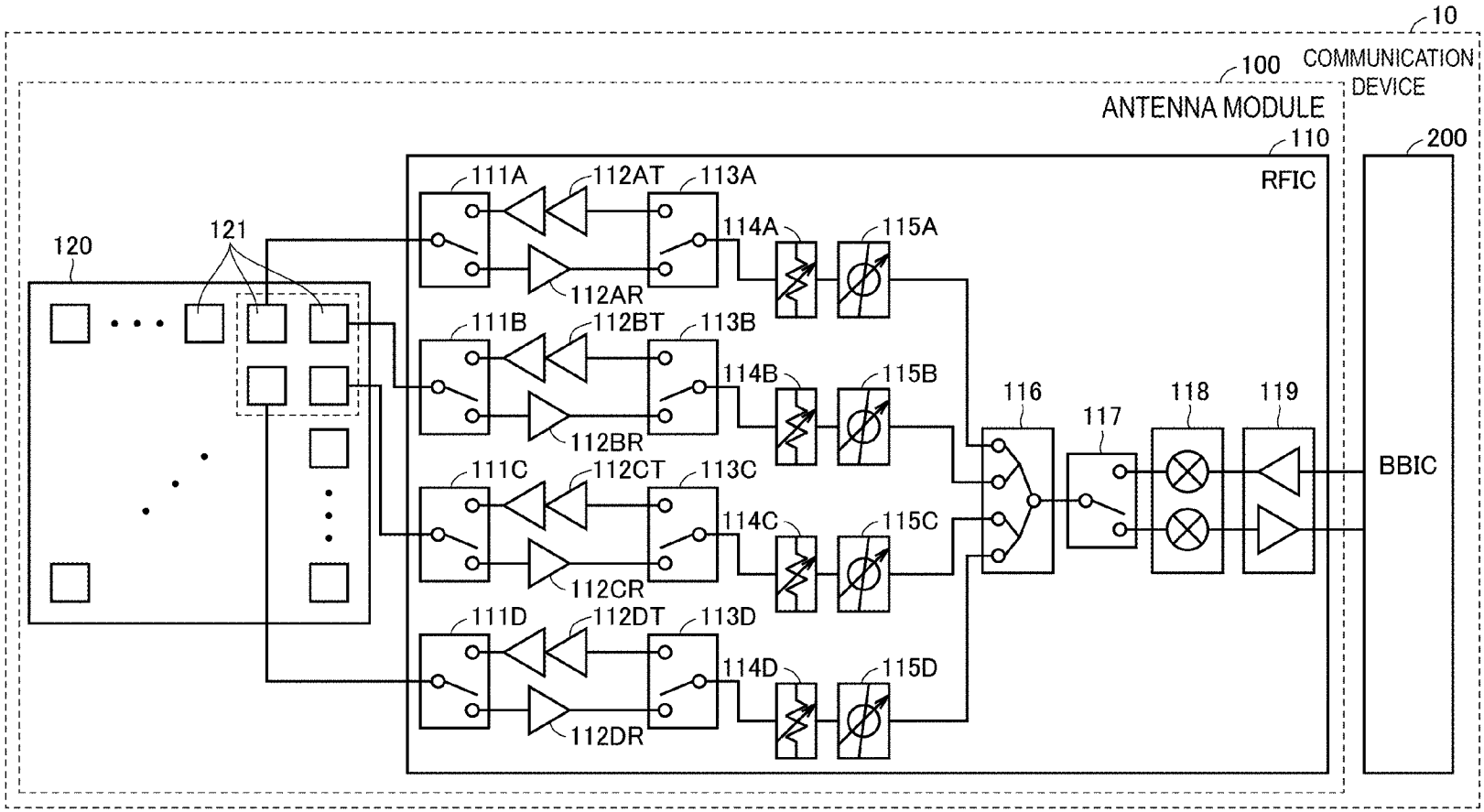
FIG. 1 is a block diagram of a communication device to which an antenna device according to an embodiment is applied.

Hereinafter, embodiments of the present disclosure will be described in detail with reference to the drawings. Note that the same reference numerals are assigned to the same or corresponding parts in the drawings, and the description thereof will not be repeated.

[Basic Configuration of Communication Device]

FIG. 1 is a block diagram of an example of a communication device 10 to which an antenna device 120 according to a present embodiment 1 is applied. The communication device 10 is, for example, a mobile phone, a mobile terminal such as a smartphone, a tablet, or the like, or a personal computer with a communication function.

Referring to FIG. 1, the communication device 10 includes an antenna module 100 and a BBIC 200 that forms a base-band signal processing circuit. The antenna module 100 includes a RFIC 110, which is one example of a feed circuit, and the antenna device 120. The communication device 10 up-converts a signal sent from the BBIC 200 to the antenna module 100 into a radio frequency signal and radiates from the antenna device 120, and also down-converts a radio frequency signal received by the antenna device 120 into a signal and processes the signal at the BBIC 200.

Note that in FIG. 1, for ease of description, of a plurality of feed elements 121 forming the antenna device 120, only the configuration corresponding to four feed elements 121 is illustrated, and the configuration corresponding to other feed elements 121 having a similar configuration is omitted. Further, in the present embodiment, as an example, a case where the feed element 121 is a patch antenna having a rectangular plate shape is described.

The RFIC 110 includes switches 111A to 111D, 113A to 113D, and 117, power amplifier 112AT to 112DT, low noise amplifiers 112AR to 112DR, attenuators 114A to 114D, phase shifters 115A to 115D, a signal multiplexer/demultiplexer 116, a mixer 118, and an amplifier circuit 119.

When a radio frequency signal is transmitted, the switches 111A to 111D and 113A to 113D are switched to the power amplifiers 112AT to 112DT sides, and the switch 117 is connected to a transmitting-side amplifier of the amplifier circuit 119. When a radio frequency signal is received, the switches 111A to 111D and 113A to 113D are switched to the low noise amplifiers 112AR to 112DR sides, and the switch 117 is connected to a receiving-side amplifier of the amplifier circuit 119.

A signal sent from the BBIC 200 is amplified at the amplifier circuit 119 and up-converted at the mixer 118. A transmitting signal that is an up-converted radio frequency signal is split into four signals at the signal multiplexer/demultiplexer 116 and fed to the respective feed elements 121 that are different from each other after traveling through four signal paths. At this time, the directivity of the antenna device 120 can be adjusted by individually adjusting the degrees of phase shift of the phase shifters 115A to 115D placed in respective signal paths.

Receiving signals that are radio frequency signals received by the feed elements 121 are respectively sent through four different signal paths and multiplexed at the signal multiplexer/demultiplexer 116. A multiplexed receiving signal is down-converted at the mixer 118, amplified at the amplifier circuit 119, and sent to the BBIC 200.

The RFIC 110 is formed as, for example, a one-chip integrated circuit component including the foregoing circuit configuration. Alternatively, devices (switch, power amplifier, low noise amplifier, attenuator, and phase shifter) corresponding to each feed element 121 in the RFIC 110 may be formed as components of a one-chip integrated circuit for each feed element 121.

[Structure of Antenna Module]

Figure 2:
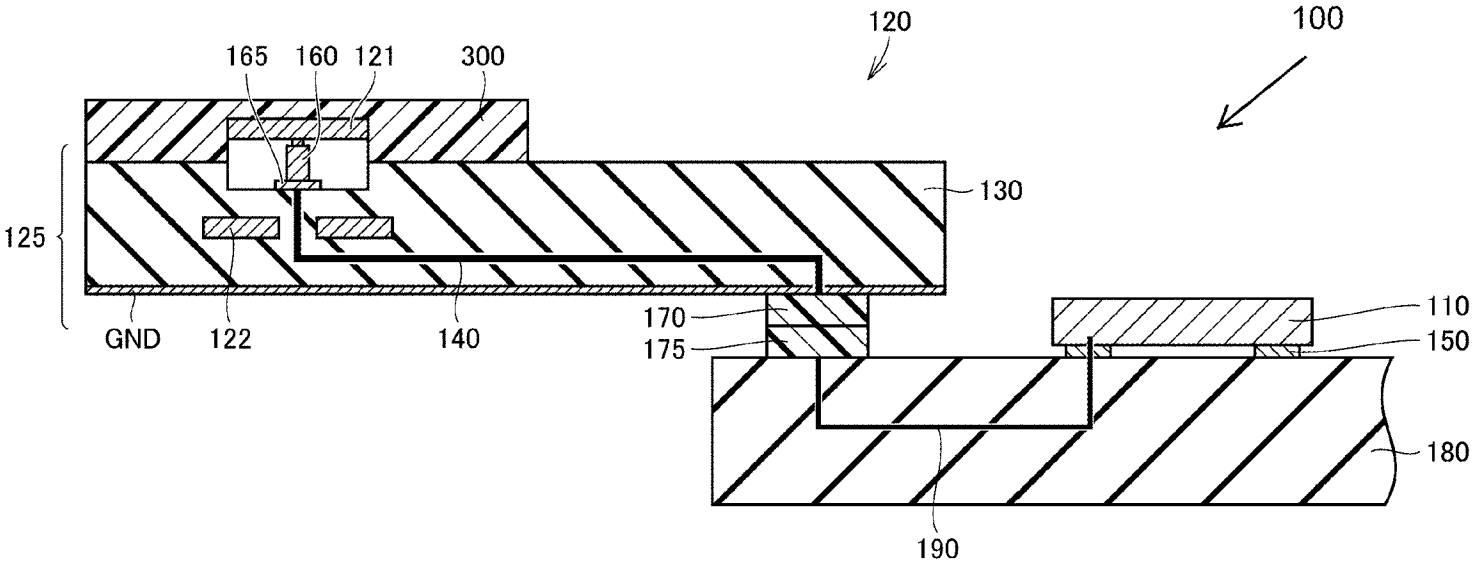
FIG. 2 is a cross-sectional view of an antenna module of FIG. 1.

A more detailed structure of the antenna module 100 is described using FIG. 2. Referring to FIG. 2, in addition to the feed elements 121, the antenna device 120 includes a circuit board 125. The circuit board 125 includes a parasitic element 122, a dielectric substrate 130, a feed line 140, a conductive member 160, an electrode pad 165, a connector 170, and a ground electrode GND. The feed element 121 is placed in or on a housing 300 of the communication device 10, and the antenna device 120 is formed by attaching the circuit board 125 to the housing 300.

Note that in FIG. 2 and FIG. 5 to FIG. 7 which will be described later, for ease of description, the case where only one feed element 121 is placed in the antenna device 120 is described. However, as illustrated in FIG. 1 and in an antenna device 120A of FIG. 3, the configuration may alternatively be such that a plurality of feed elements 121 is placed therein. Further, in some cases, the feed element 121 and the parasitic element 122 are collectively referred to as a "radiating element".

The dielectric substrate 130 is, for example, a substrate formed in such a manner as to have a multilayer structure composed of resin such as epoxy, polyimide, or the like. Further, the dielectric substrate 130 may alternatively be composed of liquid crystal polymer (LCP) having a lower permittivity, fluorine resin, low temperature co-fired ceramics (LTCC), or the like. Further, the dielectric substrate 130 may be a flexible substrate having flexibility.

The dielectric substrate 130 is attached to the housing 300 of the communication device 10 using a fastening member such as a double-sided tape, a bolt, or the like. The housing 300 is composed of, for example, a resin such as Acrylonitrile Butadiene Styrene (ABS), polycarbonate, or an insulating material such as glass or the like. The ground electrode (ground layer) GND is formed on a surface of the dielectric substrate 130 on the side opposite to the housing 300. Alternatively, the ground electrode GND may be formed within the dielectric substrate 130.

The feed element 121 is placed in a depression formed in the housing 300 of the communication device 10. A depression is also formed at a part of the dielectric substrate 130 opposite to the depression formed in the housing 300. In the depression of the dielectric substrate 130, the electrode pad 165 is formed. The feed line 140 formed within the dielectric substrate 130 is electrically connected to the electrode pad 165. The feed line 140 sends a radio frequency signal supplied from the RFIC 110 to the electrode pad 165.

The conductive member 160 is placed between the electrode pad 165 and the feed element 121. The conductive member 160 is, for example, a member that exerts elastic force, such as a spring terminal or an electrically conductive elastomer, and configured in such a manner as to press the feed element 121 with a predetermined elastic force when the circuit board 125 is attached to the housing 300. A radio frequency signal from the RFIC 110 is supplied to the feed element 121 by causing the conductive member 160 to be pressed against the feed element 121 and establishing electrical connection therebetween.

The parasitic element 122 is formed within the dielectric substrate 130 at a location where the parasitic element 122 and the feed element 121 are at least partially overlapped when viewed in the plan view of the antenna device 120. In the dielectric substrate 130, the feed line 140 goes through a layer between the parasitic element 122 and the ground electrode GND and reaches the electrode pad 165 through a through-hole formed in the parasitic element 122.

Note that instead of the feed line 140, it is also possible to configure the conductive member 160 in such a manner as to penetrate through the parasitic element 122. However, the diameter of the through-hole formed in the parasitic element 122 can be made smaller in the case where the feed line 140 penetrates the parasitic element 122, and therefore this case has an advantageous effect in that an influence on the radiation characteristics of the parasitic element 122 can be reduced further.

The size of the parasitic element 122 is larger than the size of the feed element 121. This enables to radiate, from the parasitic element 122, a radio wave of a frequency band different from that of the feed element 121. In other words, the antenna device can be configured as a dual-band compatible antenna device.

Note that in general, the smaller the size of a radiating element is, the higher the resonant frequency of the radiating element is. In other words, the resonant frequency of the feed element 121 is higher than the resonant frequency of the parasitic element 122. Accordingly, the frequency of a radio wave radiated from the feed element 121 is higher than the frequency of a radio wave radiated from the parasitic element 122.

The connector 170 is placed on a surface of the dielectric substrate 130 on the ground electrode GND side. The connector 170 is configured in such a manner as to be connectable to a connector 175 mounted on a mounting board 180.

The RFIC 110 is mounted on a surface of the mounting board 180 using a connecting member such as a solder bump or the like. A radio frequency signal from the RFIC 110 is electrically connected to the connector 175 via a feed line 190 formed within the mounting board 180. Connecting the connector 170 and the connector 175 enables the electrical connection between the feed line 140 of the antenna device 120 and the feed line 190 of the mounting board 180, and thus a radio frequency signal is supplied from the RFIC 110 to the feed element 121.

In antenna devices, in many cases, a feed element radiating a radio wave is formed in or on a dielectric substrate. Further, for example, as disclosed in Japanese Unexamined Patent Application Publication No. 2012-235351 (Patent Document 1), a feed element is sometimes placed in such a manner as to have space between the feed element and a housing of a device. In such an antenna device, a part of a radio wave radiated from the feed element is reflected at the housing. Therefore, the radio wave radiated from the feed element interferes with the radio wave reflected at the housing, and there is a possibility that in some cases the desired antenna characteristics may not be obtained.

In the antenna device according to the present embodiment, the feed element is placed in or on the housing of the communication device, and a radio frequency signal from the RFIC is supplied to the feed element using the conductive member placed in or on the dielectric substrate. Compared with the case where space is formed between the feed element and the housing, because the feed element is directly placed in or on the housing, the reflection of a radio wave, which is radiated from the feed element, at the housing can be reduced. This enables to suppress the degradation of the antenna characteristics due to the reflection from the housing.

(Array Structure)

Figure 3:
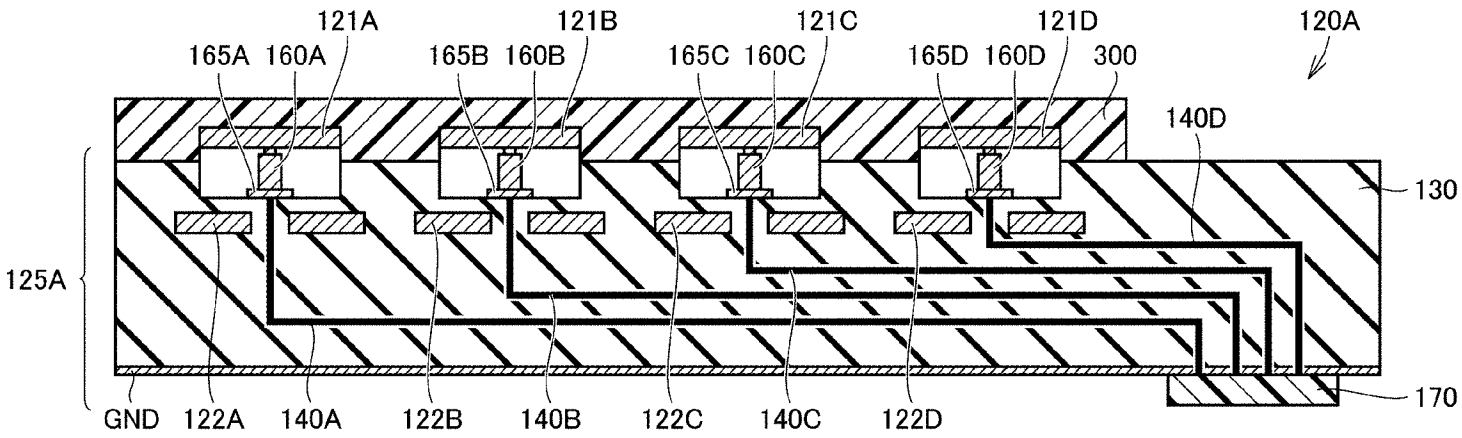
FIG. 3 is a cross-sectional view of an antenna device formed as an antenna array.

FIG. 3 is a cross-sectional view of an antenna device 120A formed as an antenna array. In the antenna device 120A, a plurality of feed elements 121A to 121D is placed on the housing 300, and a plurality of parasitic elements 122A to 122D corresponding thereto is formed in the dielectric substrate 130 of a circuit board 125A. Each antenna formed of a pair of a feed element and a parasitic element has the same configuration as that of the antenna formed of a pair of the feed element 121 and the parasitic element 122 described using FIG. 2.

In other words, a radio frequency signal is supplied to the feed element 121A from the RFIC 110 via a feed line 140A, an electrode pad 165A, and a conductive member 160A. Similarly, radio frequency signals from the RFIC 110 are supplied to the feed elements 121B to 121D via the corresponding feed lines 140B to 140D, electrode pads 165B to 165D, and conductive members 160B to 160D, respectively. The feed lines 140A to 140D are connected to the corresponding electrode pads 165A to 165D through through-holes formed in the corresponding parasitic elements 122A to 122D.

Figure 4:
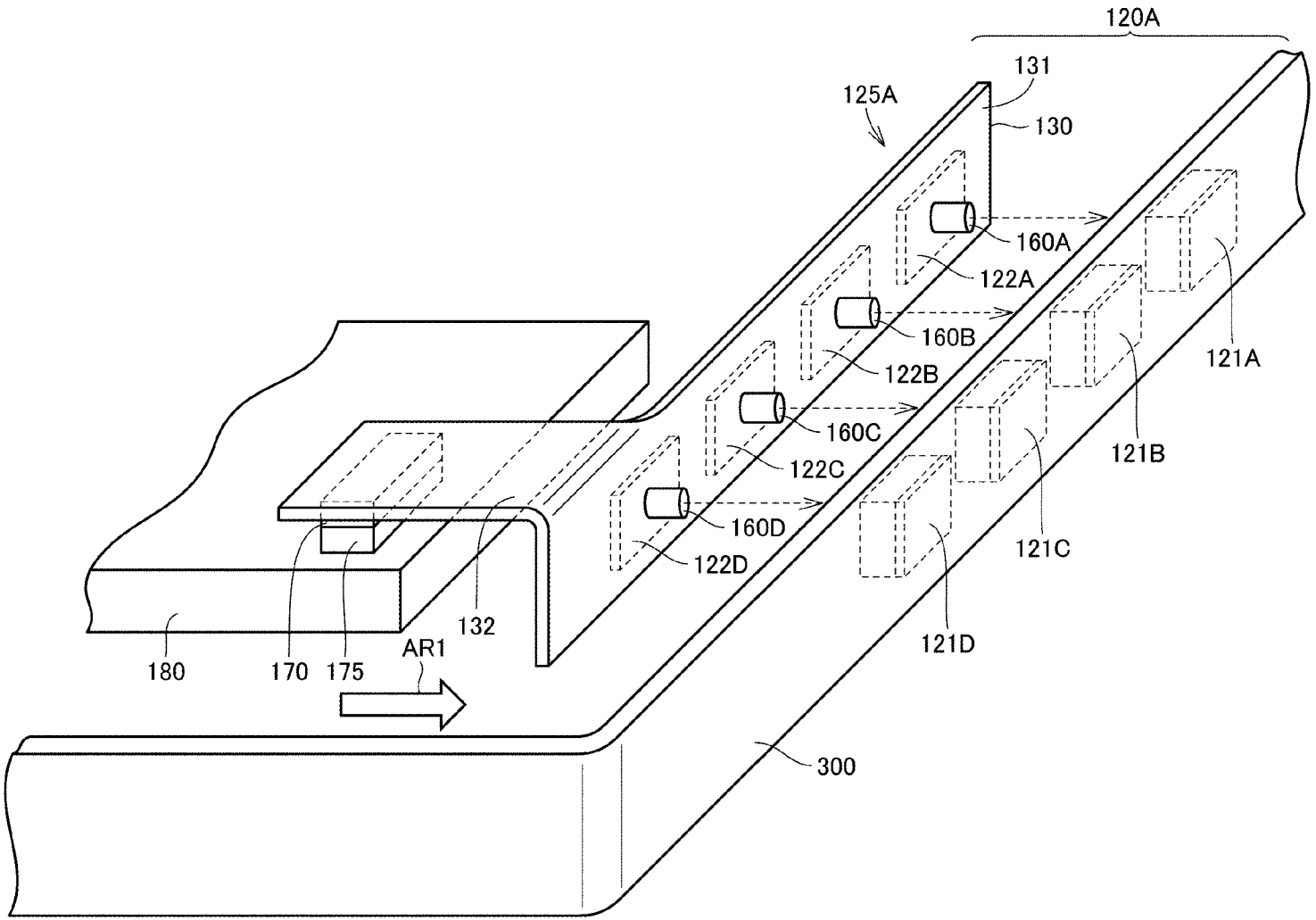
FIG. 4 is a perspective view of a mounting example of the antenna device of FIG. 3.
Figure 5:
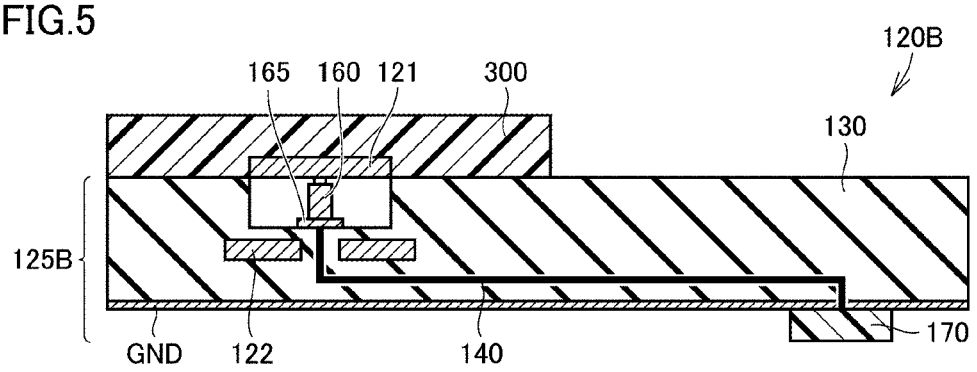
FIG. 5 is a cross-sectional view of an antenna device according to a modified example 1.

FIG. 4 is a perspective view of a mounting example of the antenna device 120A illustrated in FIG. 3. Referring to FIG. 4, in the example of the antenna device 120A, the dielectric substrate 130 of the circuit board 125A has a shape such that a substantially L-shaped flat plate having a linear-shaped first portion 131 and a second portion 132 projecting from an end part of the first portion 131 is bent in such a way that the second portion 132 is bent from the first portion 131. In a layer within the first portion 131, the parasitic elements 122A to 122D are formed, and the conductive members 160A to 160D connected to the feed lines 140A to 140D that respectively penetrate the parasitic elements 122A to 122D are projected in a direction toward the housing 300 of the communication device 10.

The connector 170 is placed on one of the sides of the second portion 132 of the dielectric substrate 130. The connector 170 is connected to the connector 175 mounted on the mounting board 180. This causes the RFIC 110 (not illustrated in FIG. 4) mounted on the mounting board 180 to be electrically connected to the circuit board 125A.

In the housing 300, depressions are formed at the parts opposite to the conductive members 160A to 160D, and on the bottom faces of the depressions, the corresponding feed elements 121A to 121D are respectively placed. By attaching the circuit board 125A connected to the mounting board 180 to the housing 300 by moving this circuit board 125A to a direction of an arrow AR1 from the state of FIG. 4, the conductive members 160A to 160D are electrically connected to the corresponding feed elements 121A to 121D, respectively. In this way, the antenna device 120A is formed.

Modified Example 1

In the antenna devices illustrated in the foregoing FIG. 2 and FIG. 3, the configuration in which the feed element 121 is placed in the depression formed in the housing 300 is described. In other words, in FIG. 2 and FIG. 3, the feed element 121 is placed in such a way that the face of the feed element 121 in contact with the conductive member 160 is located at an inner side of the housing compared with the surface of the housing 300.

However, the feed element 121 may not be necessarily placed within the housing 300. Alternatively, as in an antenna device 120B according to a modified example 1 illustrated in FIG. 5, the configuration may be such that the feed element 121 is placed at the surface of the housing 300. In this case, in a circuit board 125B, the dimensions of the depression and the conductive member 160 are determined in such a way that the feed element 121 and the conductive element 160 are brought in contact with each other at the same level as the surface of the dielectric substrate 130.

Modified Example 2

In the foregoing antenna devices, the case where the antenna device is a dual-band compatible antenna device that radiates radio waves of two different frequency bands. Alternatively, the antenna device may radiate radio waves of three or more frequency bands.

Figure 6:
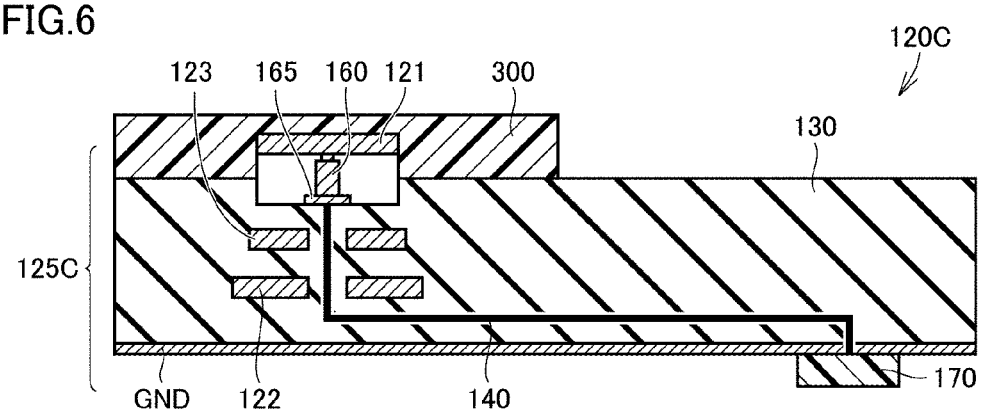
FIG. 6 is a cross-sectional view of a first example of an antenna device according to a modified example 2.

FIG. 6 is a cross-sectional view of an antenna device 120C according to a modified example 2. In the antenna device 120C, in addition to the parasitic element 122, a parasitic element 123 is formed within the dielectric substrate 130 of a circuit board 125C.

The parasitic element 123 is formed in such a manner as to be located within the dielectric substrate 130 between the feed element 121 and the parasitic element 122. Further, when viewed in the plan view of the antenna device 120C, the parasitic element 123 overlaps at least partially with each of the feed element 121 and the parasitic element 122.

A through-hole is formed in the parasitic element 123, and the feed line 140 goes through this through-hole and is connected to the electrode pad 165. The size of the parasitic element 123 is smaller than the size of the parasitic element 122 and larger than the size of the feed element 121. By employing such configuration, the parasitic element 123 radiates a radio wave of a frequency band that is between the frequency band of a radio wave radiated from the feed element 121 and the frequency band of a radio wave radiated from the parasitic element 122.

Figure 7:
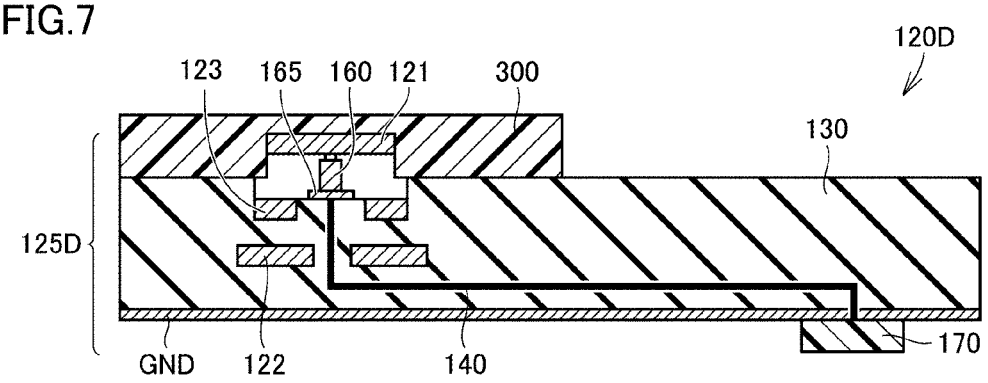
FIG. 7 is a cross-sectional view of a second example of the antenna device according to the modified example 2.

Note that the entirety of a parasitic element is not necessarily surrounded by the dielectric substrate 130, and as in the parasitic element 123 of an antenna device 120D illustrated in FIG. 7, the parasitic element may alternatively be placed in such a way that a surface of the parasitic element is exposed at the bottom face of a depression formed in the dielectric substrate 130 of a circuit board 125D. In the case where such arrangement is used, the parasitic element 123 can be used as an indication of depth at the time of removing a dielectric material when forming the depression in the dielectric substrate 130 by laser processing or the like.

Note that in the foregoing description, the configuration in which the feed element and the parasitic element radiate a single polarized wave is described, however, the configuration may alternatively be such that the feed element and the parasitic element radiate two polarized radio waves.

It is to be understood that the embodiments described in the present disclosure are exemplary in all aspects and are not restrictive. It is intended that the scope of the present disclosure is determined by the claims, not by the description of embodiments described above, and includes all variations which come within the meaning and range of equivalency of the claims.

10 Communication device
121, 121A-121D Feed element
100 Antenna module
111A-111D, 113A-113D, 117 Switch
112AR-112DR Low noise amplifier
112AT-112DT Power amplifier
114A-114D Attenuator
115A-115D Phase shifter
116 Signal multiplexer/demultiplexer
118 Mixer
119 Amplifier circuit
120, 120A-120D Antenna device
122, 122A-122D, 123 Parasitic element
125, 125A-125D Circuit board
130 Dielectric substrate
40, 140A-140D, 190 Feed line
160, 160A-160D Conductive member
165, 165A Electrode pad
170, 175 Connector
180 Mounting board
300 Housing
GND Ground electrode

The invention claimed is:

1. An antenna device enclosed in a housing, comprising:
a dielectric substrate having a plurality of layers including a ground layer stacked on top of one another;
a first radiating element placed within or on a surface of the housing;
a second radiating element placed in the dielectric substrate;
a feed line for supplying a radio frequency signal, the feed line being placed in the dielectric substrate in a layer between a layer having the second radiating element placed and the ground layer; and
a conductive member placed in or on the dielectric substrate, wherein
the conductive member is configured to electrically connect the feed line to the first radiating element and supply a radio frequency signal to the first radiating element when the dielectric substrate is attached to the housing.

2. The antenna device according to claim 1, wherein when viewed in a plan view of the antenna device, the second radiating element overlaps at least partially with the first radiating element.

3. The antenna device according to claim 1, wherein the second radiating element is a parasitic element placed in a layer closer to the ground layer than the conductive member.

4. The antenna device according to claim 1, wherein the second radiating element is exposed at a surface of the dielectric substrate.

5. The antenna device according to claim 1, wherein
the antenna device includes a plurality of radiating elements including the first radiating element and the second radiating element, and
among the plurality of radiating elements, the first radiating element is placed at a location farthest away from the ground layer.

6. The antenna device according to claim 1, wherein a resonant frequency of the first radiating element is higher than a resonant frequency of the second radiating element.

7. The antenna device according to claim 1, wherein a through-hole is provided in the second radiating element, and the feed line goes through the through-hole.

8. The antenna device according to claim 1, further comprising:
a third radiating element placed in the dielectric substrate in a layer between a layer having the second radiating element placed and the ground layer, wherein
the third radiating element is a parasitic element, and when viewed in a plan view of the antenna device, the third radiating element overlaps at least partially with each of the first radiating element and the second radiating element.

9. The antenna device according to claim 1, wherein the dielectric substrate is a flexible substrate having flexibility.

10. An antenna module including the antenna device according to claim 1, wherein
the antenna device further includes a first connector mounted on the dielectric substrate, the first connector being electrically connected to the feed line,
the antenna module includes
a mounting board on which the dielectric substrate is mounted,
a feed circuit mounted on the mounting board, and
a second connector mounted on the mounting board, the second connector being electrically connected to the feed circuit, and
by connecting the first connector and the second connector, a radio frequency signal is supplied to the first radiating element from the feed circuit via the feed line.

11. A circuit board configured to provide the antenna device according to claim 1 by combining the circuit board with a first radiating element placed in or on a housing, the circuit board comprising:
a dielectric substrate having a plurality of layers including a ground layer stacked on top of one another;
a second radiating element placed in the dielectric substrate;
a feed line for supplying a radio frequency signal, the feed line being placed in the dielectric substrate in a layer between a layer having the second radiating element placed and the ground layer; and
a conductive member placed in or on the dielectric substrate, wherein
the conductive member is configured to electrically connect the feed line to the first radiating element and supply a radio frequency signal to the first radiating element when the dielectric substrate is attached to the housing.

12. The antenna device according to claim 2, wherein the second radiating element is a parasitic element placed in a layer closer to the ground layer than the conductive member.

13. The antenna device according to claim 2, wherein the second radiating element is exposed at a surface of the dielectric substrate.

14. The antenna device according to claim 3, wherein the second radiating element is exposed at a surface of the dielectric substrate.

15. The antenna device according to claim 2, wherein the antenna device includes a plurality of radiating elements including the first radiating element and the second radiating element, and among the plurality of radiating elements, the first radiating element is placed at a location farthest away from the ground layer.

16. The antenna device according to claim 3, wherein the antenna device includes a plurality of radiating elements including the first radiating element and the second radiating element, and among the plurality of radiating elements, the first radiating element is placed at a location farthest away from the ground layer.

17. The antenna device according to claim 4, wherein the antenna device includes a plurality of radiating elements including the first radiating element and the second radiating element, and among the plurality of radiating elements, the first radiating element is placed at a location farthest away from the ground layer.

18. The antenna device according to claim 2, wherein a resonant frequency of the first radiating element is higher than a resonant frequency of the second radiating element.

19. The antenna device according to claim 3, wherein a resonant frequency of the first radiating element is higher than a resonant frequency of the second radiating element.

20. The antenna device according to claim 4, wherein a resonant frequency of the first radiating element is higher than a resonant frequency of the second radiating element.

* * * * *